US007154520B2

(12) United States Patent
Fukui

(10) Patent No.: US 7,154,520 B2
(45) Date of Patent: Dec. 26, 2006

(54) THERMAL TRANSFER RECORDING METHOD AND APPARATUS

(75) Inventor: Daisuke Fukui, Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 155 days.

(21) Appl. No.: 10/950,953

(22) Filed: Sep. 27, 2004

(65) Prior Publication Data

US 2005/0068408 A1 Mar. 31, 2005

(30) Foreign Application Priority Data

Sep. 30, 2003 (JP) ..... 2003-340523

(51) Int. Cl.
*B41J 2/335* (2006.01)
*B41J 2/325* (2006.01)

(52) U.S. Cl. ..... 347/212

(58) Field of Classification Search ..... 347/200, 347/212, 176; 400/120.18
See application file for complete search history.

(56) References Cited

U.S. PATENT DOCUMENTS 6,731,319 B1 * 5/2004 Ichikawa et al. ..... 347/212

FOREIGN PATENT DOCUMENTS

JP 59-49983 * 3/1984 ..... 347/200
JP 62-039258 * 2/1987 ..... 347/200
JP 62148294 7/1987
JP 6336043 12/1994

* cited by examiner

*Primary Examiner*—Huan Tran
(74) *Attorney, Agent, or Firm*—Ladas & Parry LLP

(57) ABSTRACT

The invention provides a thermal transfer recording method which can improve surface flatness of a protective layer in the thermal transfer recording method in which the protective layer is transferred by a thermal head, and a thermal transfer recording apparatus which can realize the thermal transfer recording method. In the thermal transfer recording method in which a protective layer provided in a substrate sheet of a transfer sheet is transferred onto an image of a printing material by heat of a heat generation portion of a thermal head, arithmetic mean roughness Ra defined in JIS B 0601 is set to a value not more than 30 nm at an interface on the side of the substrate sheet of the protective layer, the part is separated into a plurality of separate portions by providing a plurality of slits in the heat generation portion, a plurality of individual electrode portions are arranged on the upstream side in a feed direction y of the plurality of separate portions, a common electrode portion is arranged on a downstream side in the feed direction y of the heat generation portion, and a flat pressurizing surface S is formed on the downstream side of the plurality of separate portions in the heat generation portion and the common electrode portion.

10 Claims, 5 Drawing Sheets

THERMAL TRANSFER RECORDING METHOD AND APPARATUS

BACKGROUND OF THE INVENTION

1. Field of the Invention

The present invention relates to a thermal transfer recording method in which a protective layer of a transfer sheet is transferred to a printing material by heat of a thermal head and a thermal transfer recording apparatus which realizes the thermal transfer recording method.

2. Description of the Related Art

When the protective layer of the transfer sheet is transferred to the printing material by the heat of the thermal head, because the thermal head has irregularity by arranging a plurality of heating portions corresponding to a pixel, the irregularity is generated in the protective layer to lose glossiness. Therefore, there is known the technology in which the protective layer is transferred by using a line heater whose heating portion continuously extends across a length corresponding to the plurality of heating portions of the thermal head (Japanese Patent No. 3314980). Further, with reference to the technology concerning this matter, there is also known the technology in which a part of a heating resistor of the thermal head or a common electrode is flatly formed (Japanese Patent Application Publication No. 63-20714).

However, in the technology of Japanese Patent No. 3314980, it is necessary that both the thermal head for image formation and the line heater for protective layer transfer are prepared in a printer, which results in fears of upsizing of the printer and increase in cost.

SUMMARY OF THE INVENTION

In view of the foregoing, it is an object of the invention to provide the thermal transfer recording method which can improve surface flatness of the protective layer in the thermal transfer recording method in which a protective layer is transferred by the thermal head, and the thermal transfer recording apparatus which can realize the thermal transfer recording method.

The thermal transfer recording method and the thermal transfer recording apparatus of the invention will be described below.

The above-described problem can be solved by a thermal transfer recording method, in which a protective layer provided on a substrate sheet of a transfer sheet is transferred onto an image of a printing material by heat of a heat generation portion of a thermal head arranged on a substrate sheet side, wherein arithmetic mean roughness Ra defined in JIS B 0601 is set to a value not more than 30 nm at an interface on the substrate sheet side of the protective layer, at least a part on an upstream side in a feed direction of the printing material in the heat generation portion of the thermal head is divided into a plurality of separate portions by providing a plurality of slits extending toward the feed direction in parallel in the part, a plurality of individual electrode portions respectively connected to the plurality of separate portions are arranged on the upstream side in the feed direction of the plurality of separate portions, a common electrode portion connected to the heat generation portion is arranged on a downstream side in the feed direction of the heat generation portion, and a pressurizing surface, which is continuously flat across a length corresponding to the plurality of separate portions, is formed on the downstream side in the feed direction of the plurality of separate portions within the heat generation portion and the common electrode portion.

According to the invention, the protrusion of the protective layer formed by the slit between the separate portions in transferring the protective layer is crushed and planarized by the flat pressurizing surface provided on the downstream side of the separate portion. Accordingly, the surface flatness of the printing material is improved and the glossiness is also improved. The effect that the glossiness of the printing material is improved by providing the flat pressurizing surface on the downstream side of the separate portion remarkably appears as the surface roughness is decreased on the substrate sheet side of the protective layer. In particular, when the arithmetic mean roughness Ra is set to a value not more than 30 nm, the effect remarkably appears. The feed direction of the printing material may be a relative feed direction for the thermal head. Therefore, the thermal transfer recording method of the invention includes not only the method for feeding the printing material to the static thermal head but also the method for driving the thermal head to the static printing material.

In a thermal transfer recording method of the invention, it is also possible that the protective layer and a color material layer transferred to the printing material to form the image are provided in area different from each other in the substrate sheet, and the color material layer of the transfer sheet is transferred to the printing material by the heat of the heat generation portion of the thermal head to form the image. In this case, because both the image formation and the transfer of the protective layer are performed by a set of the transfer sheet and the thermal head, miniaturization of the thermal transfer recording apparatus and cost reduction can be realized when compared with the case in which the transfer sheet for the color material layer and the thermal head, and the transfer sheet for the protective layer and a line heater are provided.

In a thermal transfer recording method of the invention, it is also possible that the pressurizing surface is formed at an appropriate position on the downstream side of the separate portion. For example, it is possible that the pressurizing surface is formed in the heat generation portion on the downstream side of the separate portion by providing the plurality of slits so that the plurality of slits extend to an intermediate position of the heat generation portion, or it is possible that the pressurizing surface is formed in the common electrode portion on the downstream side of the separate portion by providing the plurality of slits so that the plurality of slits extend to a boundary between the heat generation portion and the common electrode portion.

In a thermal transfer recording method of the invention, it is possible that each of the heat generation portion and the common electrode portion has a wear resistant layer with which each of the heat generation portion and the common electrode portion is covered, and a surface of the wear resistant layer is separated by the plurality of slits. In this case, the wear can be suppressed in the heat generation portion and the common electrode portion by the wear resistant layer, which allows durability of the thermal head to be enhanced.

The above-described problem can be solved by a thermal transfer recording apparatus comprising a transfer sheet having a substrate sheet and a protective layer and a thermal head which is arranged on a substrate sheet side of the transfer sheet and heats the transfer sheet by heat of a heat generation portion to transfer the protective layer onto an image of a printing material, wherein arithmetic mean roughness Ra defined in JIS B 0601 is set to a value not more than 30 nm at an interface on the substrate sheet side in the protective layer of the transfer sheet, and the thermal head has a plurality of slits which are provided in at least a part on an upstream side in a feed direction of the printing material in the heat generation portion and extends toward the feed direction in parallel to separate the part into a plurality of separate portions, a plurality of individual electrode portions which are respectively connected to the plurality of separate portions and arranged on the upstream side in the feed direction of the plurality of separate portions, a common electrode portion which is connected to the heat generation portion and arranged on a downstream side in the feed direction of the heat generation portion, and a pressurizing surface which is continuously flat across a length corresponding to the plurality of separate portions, is formed on the downstream side in the feed direction of the plurality of separate portions within the heat generation portion and the common electrode portion. The thermal transfer recording apparatus can realize the above thermal transfer recording method. The interpretation of the feed direction of the printing material is as described above.

In a thermal transfer recording apparatus of the invention, it is also possible that the protective layer and a color material layer transferred to the printing material to form the image are provided in area different from each other in the substrate sheet of the transfer sheet, and the thermal head transfers the color material layer of the transfer sheet to the printing material by the heat of the heat generation portion to form the image. It is also possible that the pressurizing surface is formed at an appropriate position on the downstream side of the separate portion. For example, it is possible that the pressurizing surface is formed in the heat generation portion on the downstream side of the separate portion by providing the plurality of slits so that the plurality of slits extend to an intermediate position of the heat generation portion, or it is possible that the pressurizing surface is formed in the common electrode portion on the downstream side of the separate portion by providing the plurality of slits so that the plurality of slits extend to a boundary between the heat generation portion and the common electrode portion. It is also possible that each of the heat generation portion and the common electrode portion has a wear resistant layer with which each of the heat generation portion and the common electrode portion is covered, and a surface of the wear resistant layer is separated by the plurality of slits. The thermal transfer recording apparatuses having these modes can realize each mode in the above thermal transfer recording method.

As described above, in accordance with the invention, the protrusion of the protective layer formed by the slit between the separate portions in transferring the protective layer is crushed and planarized by the flat pressurizing surface provided on the downstream side of the separate portion. Accordingly, the surface flatness of the printing material is improved and the glossiness is also improved.

Japanese Industrial Standards (JIS) B 0601 corresponds to International Organization for Standardization (ISO) 4287: 1997. Arithmetical mean roughness Ra defined in JIS B 0601 corresponds to Arithmetical mean deviation of the assessd profile (the roughness profile) Ra defined in ISO 4287:1997.

DETAILED DESCRIPTION OF THE PREFERRED EMBODIMENT

Figure 1A:
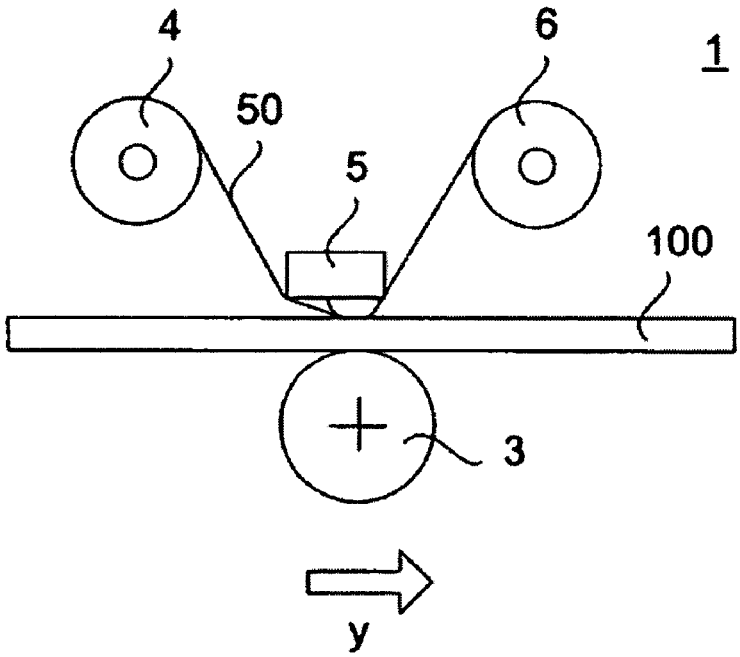
FIGS. 1A and 1B show a schematic configuration of a printer to which the invention is applied.
Figure 1B:
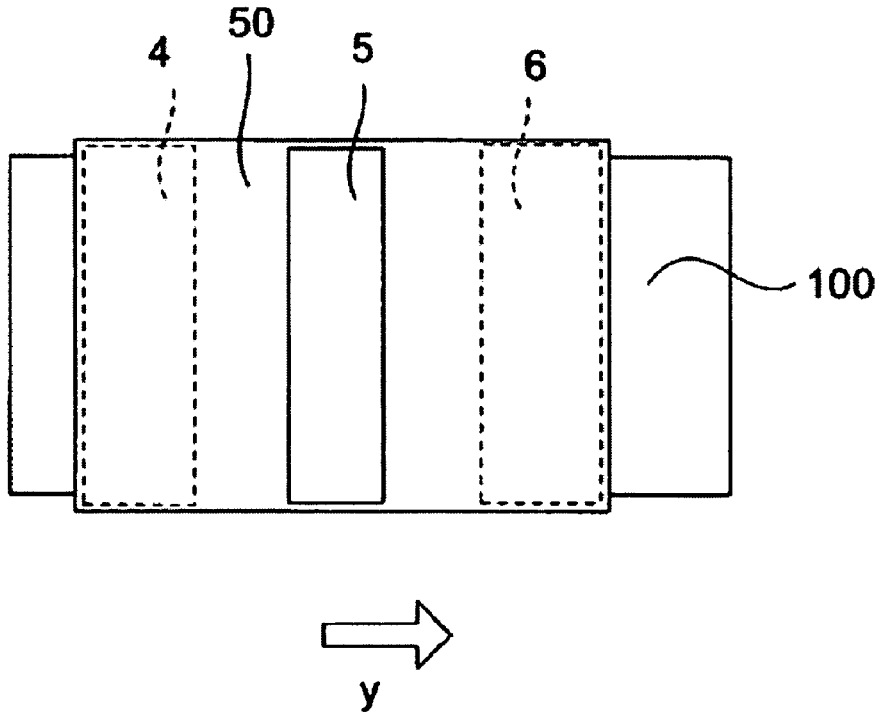

FIGS. 1A and 1B show a general outline of a printer 1 to which the thermal transfer recording method of the invention is applied. FIG. 1A is a side view of the printer 1 and FIG. 1B is a top view of the printer 1. The printer 1 is formed as the printer adopting a sublimation type of thermal transfer printer method in which the ink of a transfer sheet 50 is thermally transferred to image reception paper (printing material) 100 to form the image. For example, the image reception paper 100 is attached to the printer 1 while wound in a roll shape, and the image reception paper 100 is drawn from the roll by a quantity necessary for the printing. The image reception paper 100 has an image reception layer 100*a* on the upper surface (see FIG. 4C).

The printer 1 includes a platen roller 3 which conveys while supporting the image reception paper 100, an unwind roller 4 in which the virgin transfer sheet 50 is wounded, a thermal head 5 which heats the transfer sheet 50 unreeled from the unwind roller 4, and a wind-up roller 6 which winds up the transfer sheet 50 heated by the thermal head 5. The platen roller 3, the unwind roller 4, the thermal head 5, and the wind-up roller 6 are arranged so as to be orthogonal to a feed direction y. The platen roller 3, the unwind roller 4, the thermal head 5, and the wind-up roller 6 extend across an overall width of the image reception paper 100. The platen roller 3 and the thermal head 5 are arranged so as to be able to press the image reception paper 100 with predetermined pressure while sandwiching the image reception paper 100. For example, the platen roller 3 and the thermal head 5 can press the image reception paper 100 with pressures ranging from 20 to 30N.

Figure 2:
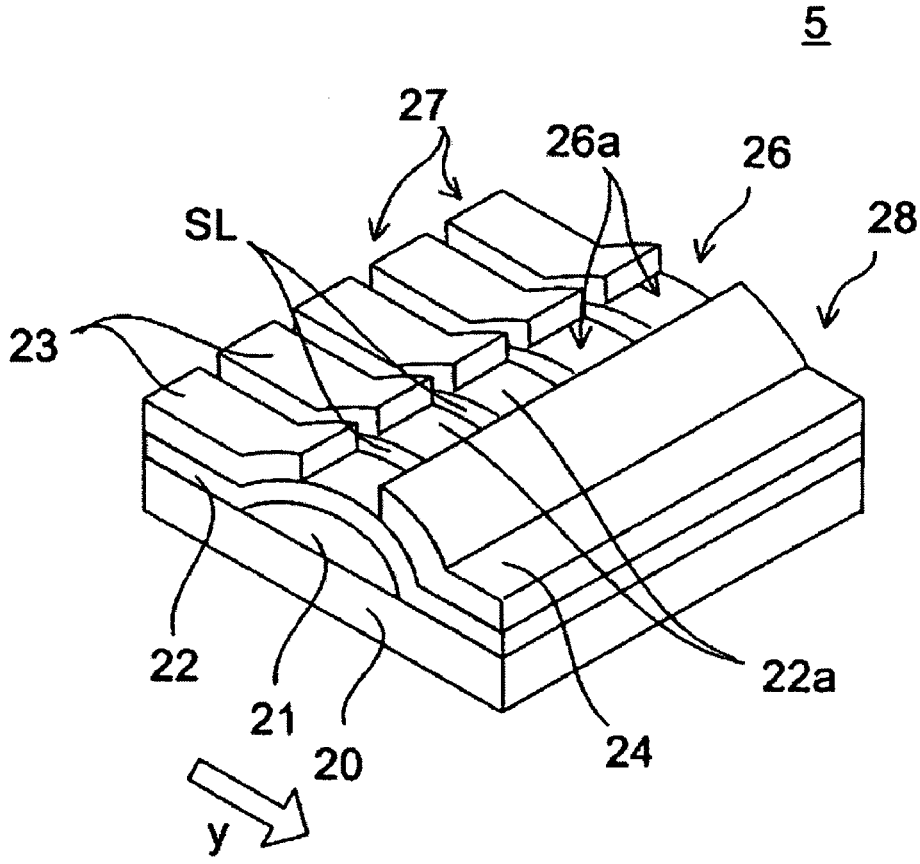
FIG. 2 is an enlarged perspective view showing a part of a thermal head of the printer shown in FIGS. 1A and 1B.
Figure 3A:
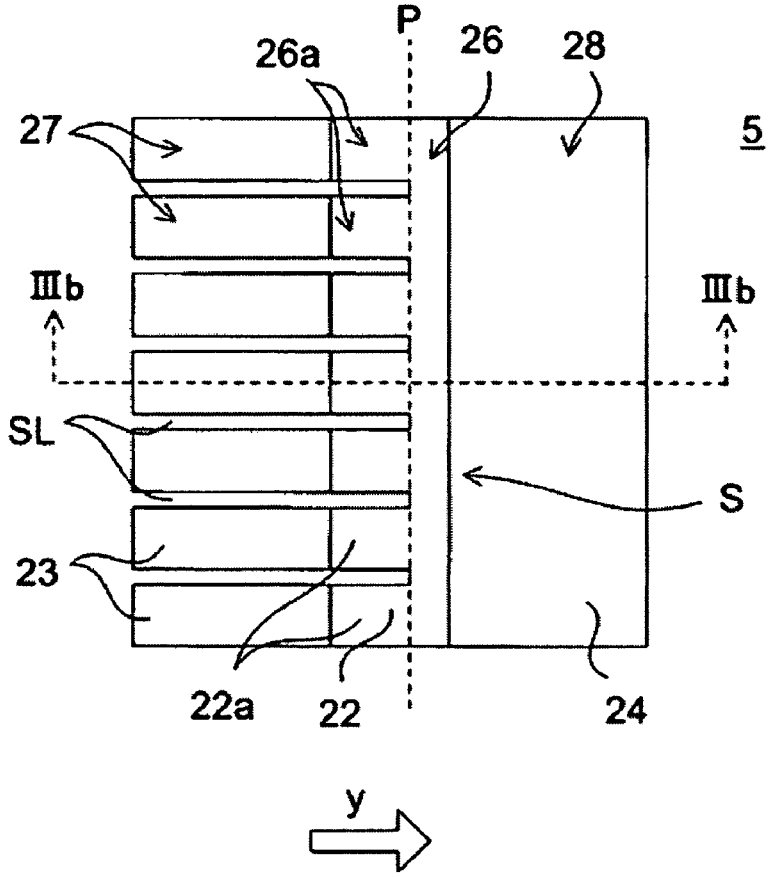
FIG. 3A is an enlarged plan view showing a part of the thermal head of the printer shown in FIGS. 1A and 1B.
Figure 3B:
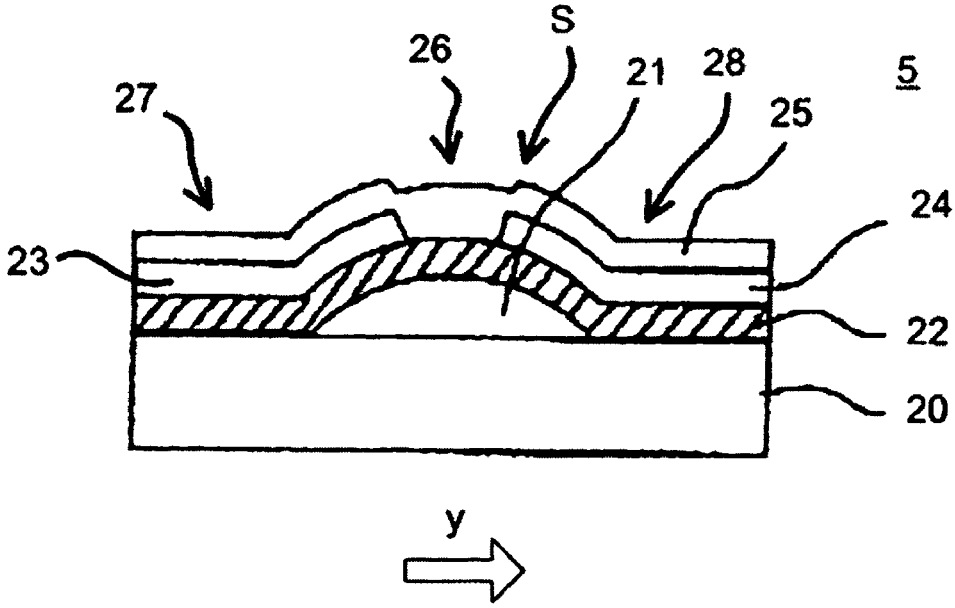
FIG. 3B is an enlarged sectional view showing the part of the thermal head of the printer shown in FIGS. 1A and 1B.

FIG. 2 is an enlarged perspective view showing a part of the thermal head 5, FIG. 3A is a plan view of the thermal head 5 when FIG. 2 is viewed from above, and FIG. 3B is a sectional view taken on line IIIb—IIIb of FIG. 3A. The upward directions of FIGS. 2 and 3B correspond to the downward direction of FIGS. 1A and 1B.

The thermal head 5 is formed by laminating a heat resistant layer 21, a heating resistor 22, individual electrodes 23, . . . , and 23, a common electrode 24, and wear resistant layer 25 on a heat radiating substrate 20. The wear resistant layer 25 is neglected in FIG. 2 and FIG. 3A.

An upstream side portion in the feed direction y of the heating resistor 22 is divided into a plurality of separate resistors 22*a*, . . . , and 22*a* by a plurality of slits SL, . . . , and SL extending along the feed direction y. The slits SL, . . . , and SL extend from the position where the individual electrodes 23, . . . , and 23 are laminated to a position P (see FIG. 3A). The position P is a downstream side of an intermediate position between the individual electrodes 23, . . . , and 23 and the common electrode 24 and the upstream side of the common electrode 24. Each of the separate resistors 22*a*, . . . , and 22*a* corresponds to one pixel.

For example, the separate resistors 22*a*, . . . , and 22*a* are formed so as to be 12 separate resistors 22*a*, . . . , and 22*a* per 1 mm.

The individual electrodes 23, . . . , and 23 are laminated on the separate resistors 22*a*, . . . , and 22*a*. The common electrode 24 is laminated on the down stream side in the feed direction y of the heating resistor 22 and continuously and flatly extends across the length corresponding to the plurality of separate resistors 22*a*, . . . , and 22*a*. The plurality of individual electrodes 23, . . . , and 23 and the common electrode 24 are arranged so as to be opposite to each other while sandwiching a top portion of a prominence of the heating resistor 22. The individual electrodes 23, . . . , and 23 are connected to a drive circuit (not shown) for performing current-carrying control respectively. The common electrode 24 is connected to an external circuit (not shown) for supplying drive current.

The wear resistant layer 25 is laminatedby, e.g. sputtering, and the surface shape of the wear resistant layer 25 is reflected in the surface shapes of the heating resistor 22, the individual electrodes 23, . . . , and 23, and the common electrode 24. That is, a pressurizing surface having the plurality of slits are formed on the upstream side of the position P and a flat pressurizing surface S is continuously formed across the length corresponding to the plurality of individual electrodes 23, . . . , and 23 on the downstream side of the position P. The slit formed on the surface of the wear resistant layer 25 results from the slit SL, namely the slit results from the separation of the heating resistor 22 in order to perform the heat control in each pixel, so that the slit is not essentially different from the slit SL. Therefore, the slit formed on the surface of the wear resistant layer 25 and the slit SL are described as slit SL without distinguishing the slit from the slit SL.

In the heating resistor 22 and the wear resistant layer 25, the portion sandwiched by the individual electrode 23 and the common electrode 24 functions as a heat generation portion 26, the portion where the wear resistant layer 25 is laminated on the individual electrode 23 function as an individual electrode portion 27, and the portion where the wear resistant layer 25 is laminated on the common electrode 24 functions as a common electrode portion 28. In the heat generation portion 26, the portions divided by the slits SL, . . . , and SL on the upstream side of the position P function as separate portions 26*a*, . . . , and 26*a* respectively.

For example, the heat radiating substrate 20 is made of ceramic, the heat resistant layer 21 is made of glass, the heating resistor 22 is made of $Ta_2N$, W, Cr, Ni—Cr, or $SnO_2$, the individual electrodes 23, . . . , and 23 and the common electrode 24 are made of Al, and the wear resistant layer 25 is made of $Ta_2O_3$, $Si_3N_4$, or SiC.

Figure 4A:
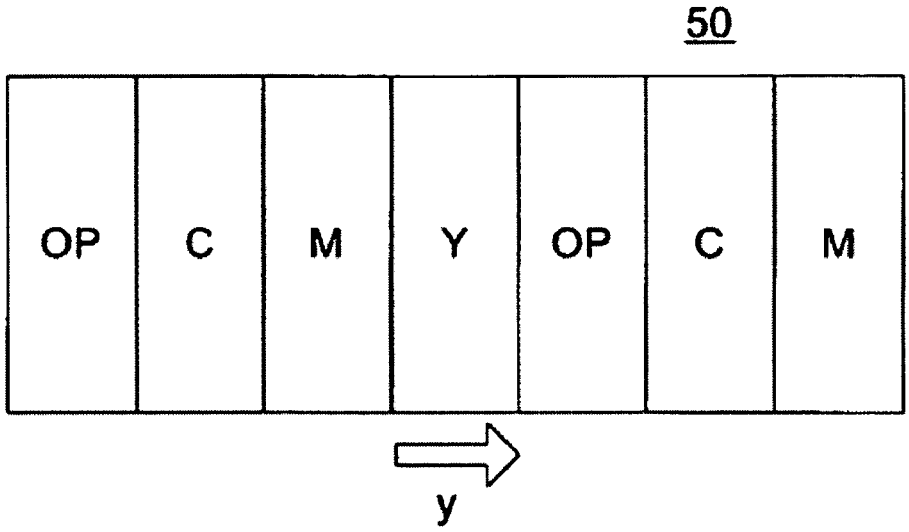
FIGS. 4A, 4B and 4C are enlarged schematic views showing a part of a transfer sheet of the printer shown in FIGS. 1A and 1B.

As shown in FIG. 4A, color material layers of yellow (Y), magenta (M), and cyan (C) and an overprint (OP) layer are sequentially provided on a substrate sheet 51 of the transfer sheet 50 along the reverse direction of the feed direction y.

Figure 4B:
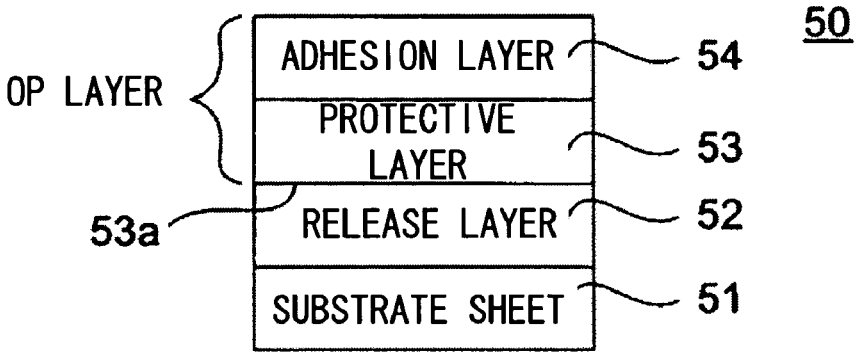

As shown in FIG. 4B, the OP layer has a protective layer 53 and an adhesion layer 54. A release layer 52, the protective layer 53, and the adhesion layer 54 are sequentially laminated on the substrate sheet 51 of the transfer sheet 50. In the protective layer 53, surface roughness is formed to be not more than 30 nm in an interface 53*a* on the side of the substrate sheet 51. The upward direction of FIG. 4B corresponds to the downward direction of FIGS. 1A and 1B. It is also possible to eliminate the release layer 52.

The action of the printer 1 having the above configuration will be described below. When the image reception paper 100 is conveyed beneath the thermal head 5 by the platen roller 3, the feed of the necessary distance of the transfer sheet 50 for changing the color material layer of the transfer sheet 50 located beneath the heat generation portion 26 and the heat control of the heat generation portions 26*a*, . . . , and 26*a* by the drive circuit (not shown) are repeated by the times corresponding to the color material layers Y, M, and C to transfer the color material layers to the image reception layer 100*a* of the image reception paper 100. Consequently, the pixel of one line in the scheduled image is formed.

Figure 4C:
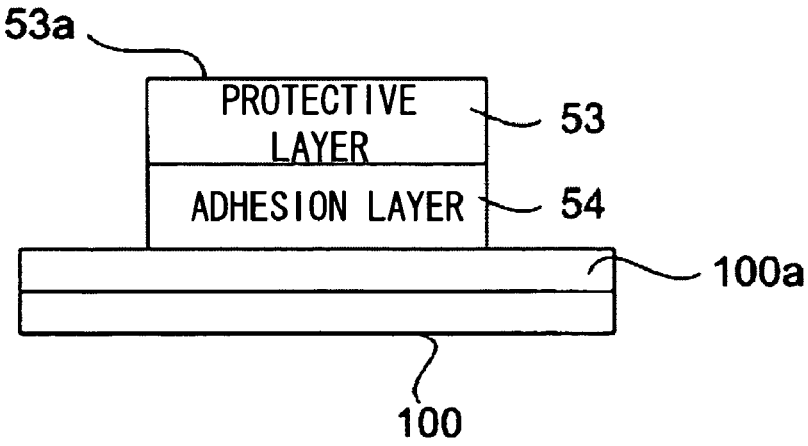

Then, the printer 1 places the area of the OP layer of the transfer sheet 50 onto the image of one line and heats all the heat generation portions 26*a*, . . . , and 26*a* while the transfer sheet 50 and the image reception paper 100 is pressed by the platen roller 3 and the thermal head 5. Therefore, as shown in FIG. 4C, the protective layer 53 and the adhesion layer 54 are transferred to the image reception paper 100. At this point, a protrusion is formed in the protective layer 53 located in the slits SL, . . . , and SL.

Then, the printer 1 ends the heat generation of the heat generation portions 26*a*, . . . , and 26*a*, and the transfer sheet 50 and the image reception paper 100 are conveyed by one line of the pixel while pressed by the platen roller 3 and the thermal head 5. At this point, the protrusion of the protective layer 53 is crushed and planarized by the pressurizing surface S. It is also possible that the transfer sheet 50 and the image reception paper 100 are not pressed by the platen roller 3 and the thermal head 5 when the one line of the pixel is conveyed. Even in this case, the protrusion of the protective layer 53 is crushed and planarized by the common electrode portion 28 when the color material layer and the like are transferred to the next one line.

As described above, in accordance with the printer 1, the surface flatness of the protective layer 53 is improved and the glossiness is also improved. The printer 1 can be preferably used for the formation of the printing material such as the photograph, and the printer 1 can be also applied to a photographic sticker machine.

The invention is not limited to the above embodiment, and various modifications could be made without departing from the scope of the technical thought of the invention.

It is possible to adopt any printing method in which the protective layer is thermally transferred onto the image. For example, a fused type thermal transfer recording method can be also adopted. Any type of known thermal head can be used. In addition to the so-called partial graze type of thermal head shown in the embodiment, for example, it is also possible to use a plane graze type of thermal head in which the heat resistant layer 21 is flatly laminated and a thermal head in which the heat radiating substrate 20 is formed in the prominence shape.

The flat pressurizing surface S is not limited to the pressurizing surface continuously flatly extending across the overall length of the thermal head 5. When the pressurizing surface S continuously extends across the length corresponding to the plurality of separate portions 26*a*, the image reception paper 100 can be planarized. It is possible that the pressuring surface S is provided at appropriate positions of the heat generation portion 26 and the common electrode portion 28 as long as the pressurizing surface S is located on the downstream side of the separate portion 26*a*. For example, like a thermal head 30 shown in FIG. 5, it is possible that the slit SL is prolonged to the common electrode portion 28, i.e. the slit SL is prolonged to the boundary between the heat generation portion 26 and the common electrode portion 28 and only the common electrode portion

28 is continuously flatly formed across the length corresponding to the plurality of separate portions 26*a*, . . . , and 26*a*.

EXAMPLE

The invention was applied to CP8000D manufactured by Mitubishi Electric Corporation to transfer the protective layer to the photographic paper. Table 1 shows condition of Example and the glossiness of the photographic paper after the transfer of the protective layer.

TABLE 1

| | Thermal head | Arithmetic mean roughness Ra (nm) | Glossiness Main-scanning direction | Glossiness Sub-scanning direction |
|---|---|---|---|---|
| Example 1 | Prototype 1 | 23 | 70 | 71 |
| Example 2 | Prototype 2 | 23 | 70 | 70 |
| Example 3 | Prototype 2 | 30 | 66 | 66 |
| Comparative Example 1 | Current product | 23 | 60 | 63 |
| Comparative Example 2 | Current product | 42 | 52 | 55 |
| Comparative Example 3 | Prototype 1 | 42 | 57 | 58 |
| Comparative Example 4 | Prototype 2 | 42 | 57 | 57 |

Figure 5:
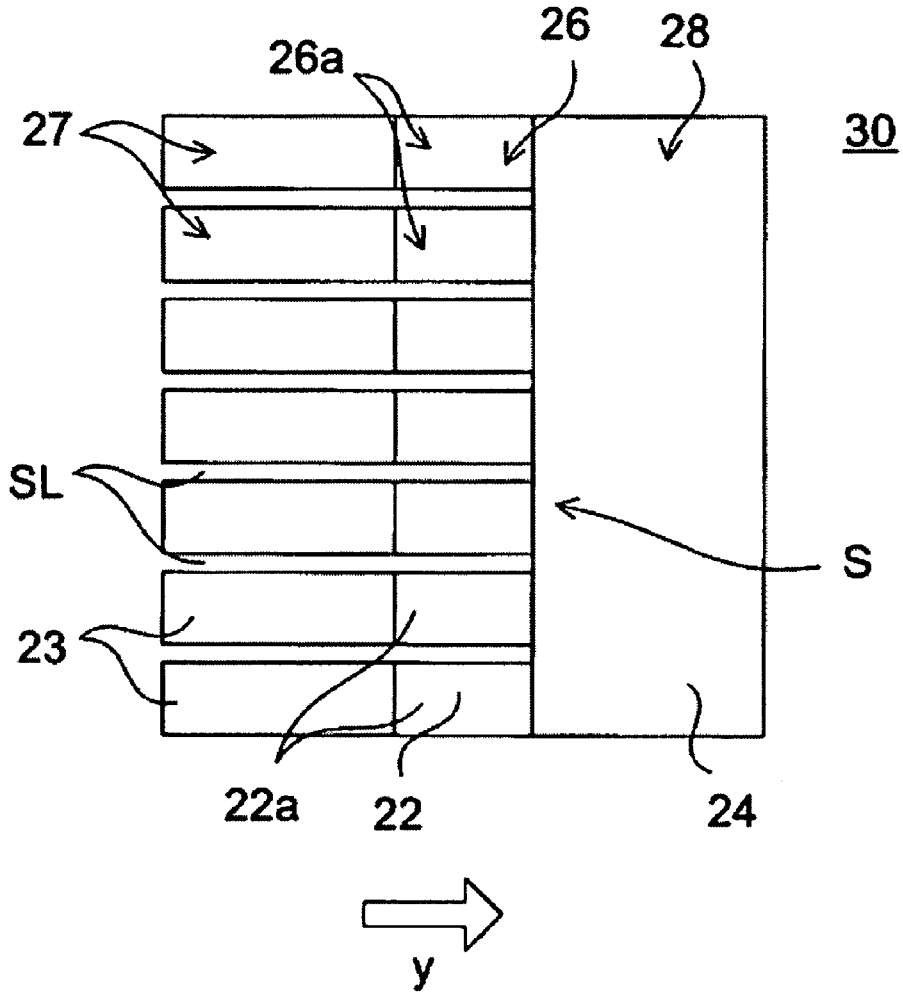
FIG. 5 is a plan view showing a modification of the thermal head of the printer shown in FIGS. 1A and 1B.

In the column of the thermal head of Table 1, Prototype 1 represents the thermal head shown in FIG. 3A in which the downstream side of the heat generation portion 26 and the common electrode portion 28 are flatly formed, Prototype 2 represents the thermal head shown in FIG. 5 in which only the common electrode portion 28 is flatly formed, and Current product represents the thermal head in which the common electrode portion 28 is also divided into the plurality of common electrode portions by the slits SL. The thermal heads of Prototype 1 and Prototype 2 were similar to the thermal head of Current product in the conditions such as the number of dots per 1 mm except that the downstream side in the feed direction was flatly formed in Prototype 1 and Prototype 2.

Arithmetic mean roughness Ra is a value of the interface on the substrate sheet side of the protective layer, and the arithmetic mean roughness Ra is set to 23 nm, 30 nm, and 42 nm. A stylus type of surface roughness checking machine (SURF COM 1400D-3DF-12, manufactured by TOKYO SEIMITU CO., LTD.) was used for measurement of the arithmetic mean roughness Ra. A cut-off value was set to 0.08 mm, an evaluation length was set to 0.4 mm, and measurement speed was set to 0.03 mm/s.

The glossiness was measured by Gloss Meter VG2000 manufactured by Nippon Denshoku Industries Co., Ltd.), and a measurement angle was set to 20°. Two types of a measurement direction were set, a printing feed direction of the printing material was set to a sub-scanning direction, and a 90° rotating direction was set to a main scanning direction. The glossiness shown in Table 1 is mirror surface glossiness at 20° defined in JIS Z 8741.

As shown in Table 1, the replacement of the thermal head from Current product to Prototype 1 or Prototype 2 eliminates the difference in glossiness between the main scanning direction and the sub-scanning direction and improves the surface flatness of the printing material. In particular, when the surface roughness is formed not more than 30 nm, the sufficient glossiness (not lower than 65) is obtained.

What is claimed is:

1. A thermal transfer recording method, in which a protective layer provided on a substrate sheet of a transfer sheet is transferred onto an image of a printing material by heat of a heat generation portion of a thermal head arranged on a substrate sheet side, wherein arithmetic mean roughness Ra defined in JIS B 0601 is set to a value not more than 30 nm at an interface on the substrate sheet side of the protective layer, at least a part on an upstream side in a feed direction of the printing material in the heat generation portion of the thermal head is divided into a plurality of separate portions by providing a plurality of slits extending toward the feed direction in parallel in the part, a plurality of individual electrode portions respectively connected to the plurality of separate portions are arranged on the upstream side in the feed direction of the plurality of separate portions, a common electrode portion connected to the heat generation portion is arranged on a downstream side in the feed direction of the heat generation portion, and a pressurizing surface, which is continuously flat across a length corresponding to the plurality of separate portions, is formed on the downstream side in the feed direction of the plurality of separate portions within the heat generation portion and the common electrode portion.

2. The thermal transfer recording method according to claim 1, wherein the protective layer and a color material layer transferred to the printing material to form the image are provided in area different from each other in the substrate sheet, and the color material layer of the transfer sheet is transferred to the printing material by the heat of the heat generation portion of the thermal head to form the image.

3. The thermal transfer recording method according to claim 1, wherein the plurality of slits are provided so as to extend to an intermediate position of the heat generation portion.

4. The thermal transfer recording method according to claim 1, wherein the plurality of slits are provided so as to extend to a boundary between the heat generation portion and the common electrode portion.

5. The thermal transfer recording method according to claim 1, wherein each of the heat generation portion and the common electrode portion has a wear resistant layer with which each of the heat generation portion and the common electrode portion is covered, and a surface of the wear resistant layer is separated by the plurality of slits.

6. A thermal transfer recording apparatus comprising a transfer sheet having a substrate sheet and a protective layer and a thermal head which is arranged on a substrate sheet side of the transfer sheet and heats the transfer sheet by heat of a heat generation portion to transfer the protective layer onto an image of a printing material, wherein arithmetic mean roughness Ra defined in JIS B 0601 is set to a value not more than 30 nm at an interface on the substrate sheet side in the protective layer of the transfer sheet, and the thermal head has a plurality of slits which are provided in at least a part on an upstream side in a feed direction of the printing material in the heat generation portion and extends toward the feed direction in parallel to separate the part into a plurality of separate portions, a plurality of individual electrode portions which are respectively connected to the plurality of separate portions and arranged on the upstream side in the feed direction of the plurality of separate portions, a common electrode portion which is connected to the heat generation portion and arranged on a downstream side in the feed direction of the heat generation portion, and a pressurizing surface which is continuously flat across a length corresponding to the plurality of separate portions, is formed on the downstream side in the feed direction of the plurality of separate portions within the heat generation portion and the common electrode portion.

7. The thermal transfer recording apparatus according to claim 6, wherein the protective layer and a color material layer transferred to the printing material to form the image are provided in area different from each other in the substrate sheet of the transfer sheet, and the thermal head transfers the color material layer of the transfer sheet to the printing material by the heat of the heat generation portion to form the image.

8. The thermal transfer recording apparatus according to claim 6, wherein the plurality of slits are provided so as to extend to an intermediate position of the heat generation portion.

9. The thermal transfer recording apparatus according to claim 6, wherein the plurality of slits are provided so as to extend to a boundary between the heat generation portion and the common electrode portion.

10. The thermal transfer recording apparatus according to claim 6, wherein each of the heat generation portion and the common electrode portion has a wear resistant layer with which each of the heat generation portion and the common electrode portion is covered, and a surface of the wear resistant layer is separated by the plurality of slits.

* * * * *